US009072638B2

(12) United States Patent
Heimbrock et al.

(10) Patent No.: US 9,072,638 B2
(45) Date of Patent: Jul. 7, 2015

(54) TRANSITION ASSIST SIDERAIL AND ARTICLE EMPLOYING THE SAME

(75) Inventors: Richard H. Heimbrock, Cincinnati, OH (US); Robert M. Zerhusen, Cincinnati, OH (US)

(73) Assignee: Hill-Rom Services, Inc., Batesville, IN (US)

( * ) Notice: Subject to any disclaimer, the term of this patent is extended or adjusted under 35 U.S.C. 154(b) by 1340 days.

(21) Appl. No.: 12/534,889

(22) Filed: Aug. 4, 2009

(65) Prior Publication Data

US 2011/0010861 A1 Jan. 20, 2011

Related U.S. Application Data

(63) Continuation of application No. 12/589,536, filed on Jul. 15, 2009, now abandoned.

(51) Int. Cl.

| | |
|---|---|
| ***A61G 7/053*** | (2006.01) |
| ***A61G 7/015*** | (2006.01) |
| *A61G 7/05* | (2006.01) |

(52) U.S. Cl.

CPC ..... *A61G 7/053* (2013.01); *A61G 7/015* (2013.01); *A61G 2007/0509* (2013.01); *A61G 2007/0514* (2013.01)

(58) Field of Classification Search

CPC ..... A61G 7/0507; A61G 2007/0524; A61G 2007/052; A61G 2007/0521; A61G 2007/0522; A61G 2007/0516; A61G 2007/0515; A61G 2007/0514; A61G 2007/0513; A61G 7/053; A61G 7/015; A61G 2007/0509; A47C 21/08

USPC ..... 5/613, 617, 618, 424, 425, 428–430, 5/662; D6/382, 390–392, 503

See application file for complete search history.

(56) References Cited

U.S. PATENT DOCUMENTS

| | | | |
|---|---|---|---|
| 5,129,117 | A | 7/1992 | Celestina |
| 5,195,200 | A | 3/1993 | Leoutsakos |

(Continued)

FOREIGN PATENT DOCUMENTS

| | | | |
|---|---|---|---|
| EP | 1512389 | A1 | 3/2005 |
| WO | 9705846 | A1 | 2/1997 |

(Continued)

OTHER PUBLICATIONS

European Search Report, "Application No. EP 10251259", (Jul. 28, 2011), The Hague.

(Continued)

*Primary Examiner* — Nicholas Polito

(74) *Attorney, Agent, or Firm* — Kenneth C. Baran

(57) ABSTRACT

An occupant support such as a bed 20 includes an articulable deck 34 having an upper body section 44 and a section 46 or 74 longitudinally adjacent to the upper body section. The upper body section is pivotable relative to the adjacent section about a laterally extending upper pivot axis. The upper body section may be pivoted to angular orientations between a substantially flat angular orientation and a maximum angular orientation. A siderail 86 affixed to the upper body section, includes a grip 102 having an ascending orientation relative to the upper body section. The grip is longitudinally bounded by a siderail back portion 106 located behind the grip and a siderail front portion 110 located in front of the grip. At least part of the front portion has a non-ascending orientation relative to the upper body section.

21 Claims, 12 Drawing Sheets

(56) References Cited

U.S. PATENT DOCUMENTS

| | | | | |
|---|---|---|---|---|
| D336,577 | S | 6/1993 | Celestina | |
| 5,337,430 | A | 8/1994 | Schlein | |
| 5,394,581 | A | 3/1995 | Leoutsakos | |
| D436,474 | S | 1/2001 | Morren | |
| 6,389,622 | B1 | 5/2002 | Her | |
| D479,070 | S | 9/2003 | Goodwin | |
| 7,028,352 | B2 * | 4/2006 | Kramer et al. | 5/425 |
| 7,100,222 | B2 * | 9/2006 | Metz et al. | 5/430 |
| 7,150,058 | B2 | 12/2006 | Rabska | |
| 7,296,312 | B2 | 11/2007 | Menkedick | |
| 7,406,731 | B2 | 8/2008 | Menkedick | |
| 7,644,457 | B2 | 1/2010 | Hensley | |
| 2004/0177443 | A1 | 9/2004 | Simmonds | |
| 2006/0038098 | A1 | 2/2006 | Metz | |
| 2006/0059621 | A1 | 3/2006 | Poulos | |
| 2006/0288480 | A1 | 12/2006 | Metz | |
| 2009/0119839 | A1 | 5/2009 | Guguin | |
| 2009/0229049 | A1 | 9/2009 | Heimbrock | |
| 2009/0229050 | A1 | 9/2009 | Heimbrock | |

FOREIGN PATENT DOCUMENTS

| | | | |
|---|---|---|---|
| WO | 2006058506 | A1 | 6/2006 |
| WO | 2007010213 | A2 | 1/2007 |

OTHER PUBLICATIONS http://www.arjohuntleigh.com/int/Product.asp?PageNumber=2571&ProductCategory_id=128&Product_id=202 ArjoHuntleigh Enterprise 8000 Hospital Bed.
http://www.arjohuntleigh.com/int/Product.asp?pagenumber=2571&Product_id=291&ProductCategory_id=128 ArjoHuntleigh Enterprise 9000 Hospital Bed.
http://www.arjohuntleigh.com/int/ProductDetails.asp-?PageNumber=2571&ProductCategory_id=128&Product_id=291 ArjoHuntleigh Enterprise 9000—Product Details—Nurse Handset.
http://www.arjohuntleigh.com/int/ProductDetails.asp-?PageNumber=2571&ProductCategory_id=128&Product_id=291 ArjoHuntleigh Enterprise 9000—Product Details—Plug in controls allow for easy changes.
Photo # 1297 (Hill-Rom Clinitron Rite-Hite).
Photo #1298 (Hill-Rom TotalCare Bariatric).
Photo # 1299 (Hill-Rom 1000).
Photo # 1300 (Hill-Rom Century P1400).
Photo # 1301 (Hill-Rom Home Care).
Photo # 1302 (Hill-Rom Affinity).
Photo # 1303 (Hill-Rom Efica CC).
Photo # 1304 (Hill-Rom Efica CC).
Photo # 1305 (Hill-Rom Clinitron Elexis).
Photo # 1306 (Hill-Rom Clinitron Elexis).
Photo # 1307 (Hill-Rom Affinity).
Photo # 1308 (Hill-Rom Century CC).
Photo # 1309 (Hill-Rom Clinitron).
Photo # 1310 (Hill-Rom 1,000,000th Bed).
Photo # 1311 (Hill-Rom Unknown Model).
Photo # 1312 (Hill-Rom Unknown Model).
Photo # 1313 (Hill-Rom Unknown Model).
Photo # 1314 (Hill-Rom Unknown Model).
Photo # 1315 (Hill-Rom CareAssist).
U.S. Appl. No. 61/225,921, filed Jul. 15, 2009 Titled "Siderail with Storage Area", Applicant(s) Robert M. Zerhusen, Assignee Name and Address: Hill-Rom Services, Inc. 300 Delaware Ave., Suite 530 Wilmington, DE 19801.
U.S. Appl. No. 12/547,054, filed Aug. 25, 2009 Titled "Medical Line Manager", Applicant(s) Richard H. Heimbrock, Assignee Name and Address: Hill-Rom Services, Inc. 300 Delaware Ave., Suite 530 Wilmington, DE 19801.
U.S. Appl. No. 12/546,756, filed Aug. 25, 2009 Titled "Siderail with Storage Area", Applicant(s) Robert M. Zerhusen, Assignee Name and Address: Hill-Rom Services, Inc. 300 Delaware Ave., Suite 530 Wilmington, DE 19801.
U.S. Appl. No. 12/548,874, filed Aug. 27, 2009 Titled "Siderail with Storage Area", Applicant(s) Charles A. Howell, Assignee Name and Address: Hill-Rom Services, Inc. 300 Delaware Ave., Suite 530 Wilmington, DE 19801.
Response to the examiner's Opinion to the European Search Report for European Patent Application No. 10251259.7 entitled, "Transition Assist Siderail and Article Employing the Same" of Hill-Rom Services, Inc. Accompanying the response includes set of amended claims and sketch filed with European Patent Office on Mar. 7, 2012.
Office Action for Japanese Application No. 2010-161012; Mailed Nov. 11, 2014.

* cited by examiner

TRANSITION ASSIST SIDERAIL AND ARTICLE EMPLOYING THE SAME

CROSS REFERENCE TO RELATED APPLICATIONS

This application claims priority to U.S. Provisional Patent Application Ser. No. 61/225,921 entitled "Siderail with Storage Area" filed on Jul. 15, 2009, which application was converted to Nonprovisional patent application Ser. No. 12/589,536 on May 5, 2010 bearing the same title, the contents of which are incorporated herein by reference.

TECHNICAL FIELD

The subject matter described herein relates to beds and other occupant supports having a siderail, and particularly to a siderail that facilitates occupant ingress and egress.

BACKGROUND

Beds, such as those used in hospitals and other settings, are ordinarily equipped with a deck, a mattress that rests on the deck, and siderails. A common arrangement features four siderails, a head siderail and a foot siderail bordering the mattress along the left lateral side of the bed and another head and foot siderail bordering the mattress along the right lateral side of the bed. Typically such siderails can be raised (deployed) or stored. When raised, a substantial portion of the siderail is above the top of the mattress, making it easy for the bed occupant to discern the location of the lateral edges of the mattress. When a siderail is stored, the top of the siderail is typically vertically below the top of the mattress, which allows the occupant to easily leave or enter the bed. To facilitate ingress and egress (collectively referred to herein as "transition") the foot siderail is stored and the head siderail is raised. The occupant can then brace herself on the head siderail during the transition from or onto the mattress. It is, therefore, desirable to provide a bed with a siderail whose features are designed with occupant ingress and egress in mind.

Beds of the type described above are ordinarily equipped with articulating decks. An articulating deck usually includes three or four longitudinally distributed deck sections. One or more sections are pivotable about a laterally extending axis. Articulation of the bed and/or movement of the occupant can cause the occupant to migrate toward the foot end of the bed. It is therefore useful to provide a feature in the siderail that the occupant can use to boost herself back toward the head of the bed.

SUMMARY

A bed as described herein includes an articulable deck having an upper body section and a section longitudinally adjacent to the upper body section. The upper body section is pivotable relative to the adjacent section about a laterally extending upper pivot axis. The upper body section may be pivoted to angular orientations between a substantially flat angular orientation and a maximum angular orientation. A siderail affixed to the upper body section, includes a grip having an ascending orientation relative to the upper body section. The grip is longitudinally bounded by a siderail back portion located behind the grip and a siderail front portion located in front of the grip. The front portion has a non-ascending orientation relative to the upper body section.

The foregoing and other features of the various embodiments of the occupant support and siderail described herein, will become more apparent from the following detailed description and the accompanying drawings.

DETAILED DESCRIPTION

Figure 1:
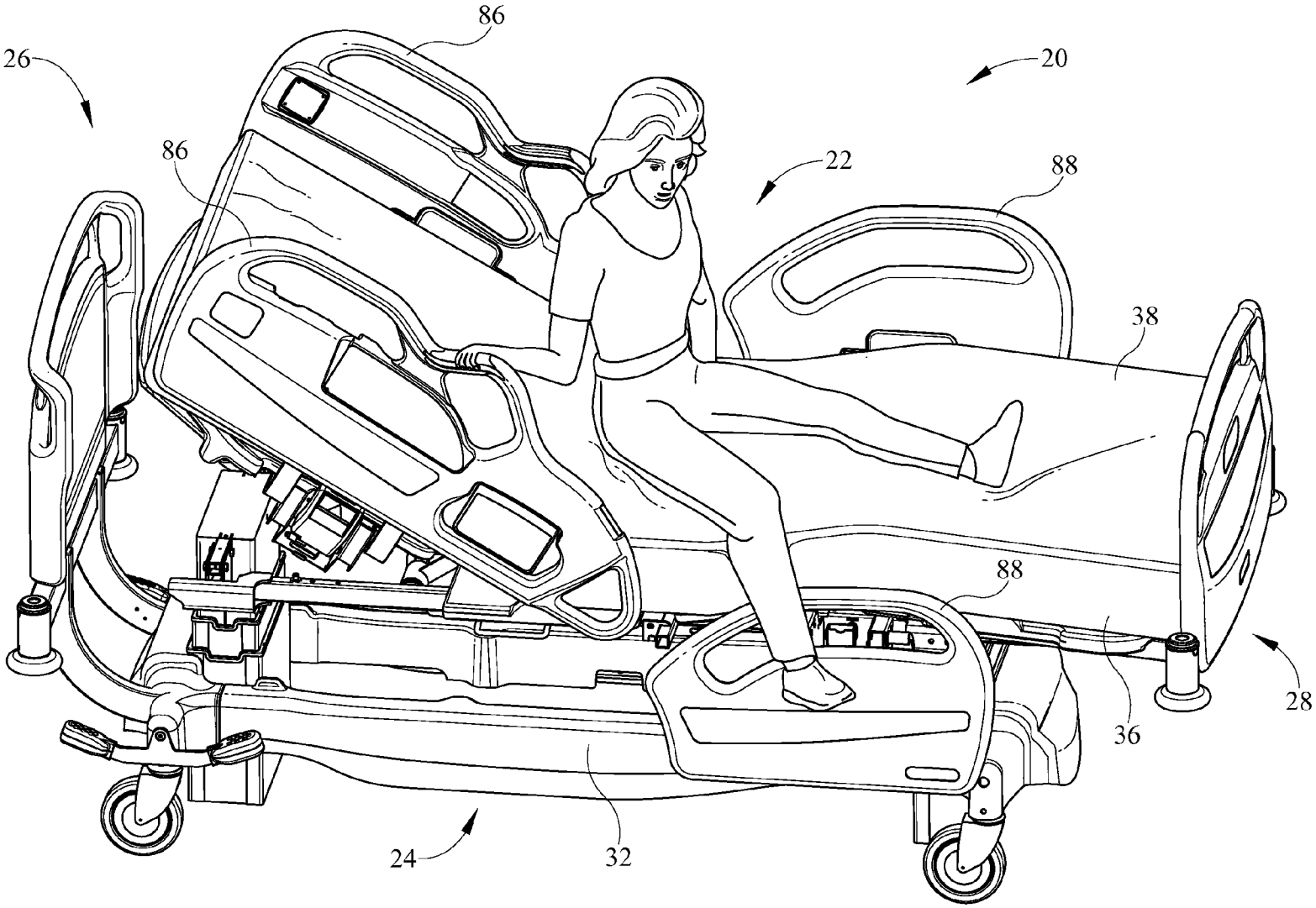
FIG. 1 is a perspective view of a hospital bed having a transition assist siderail.
Figure 2:
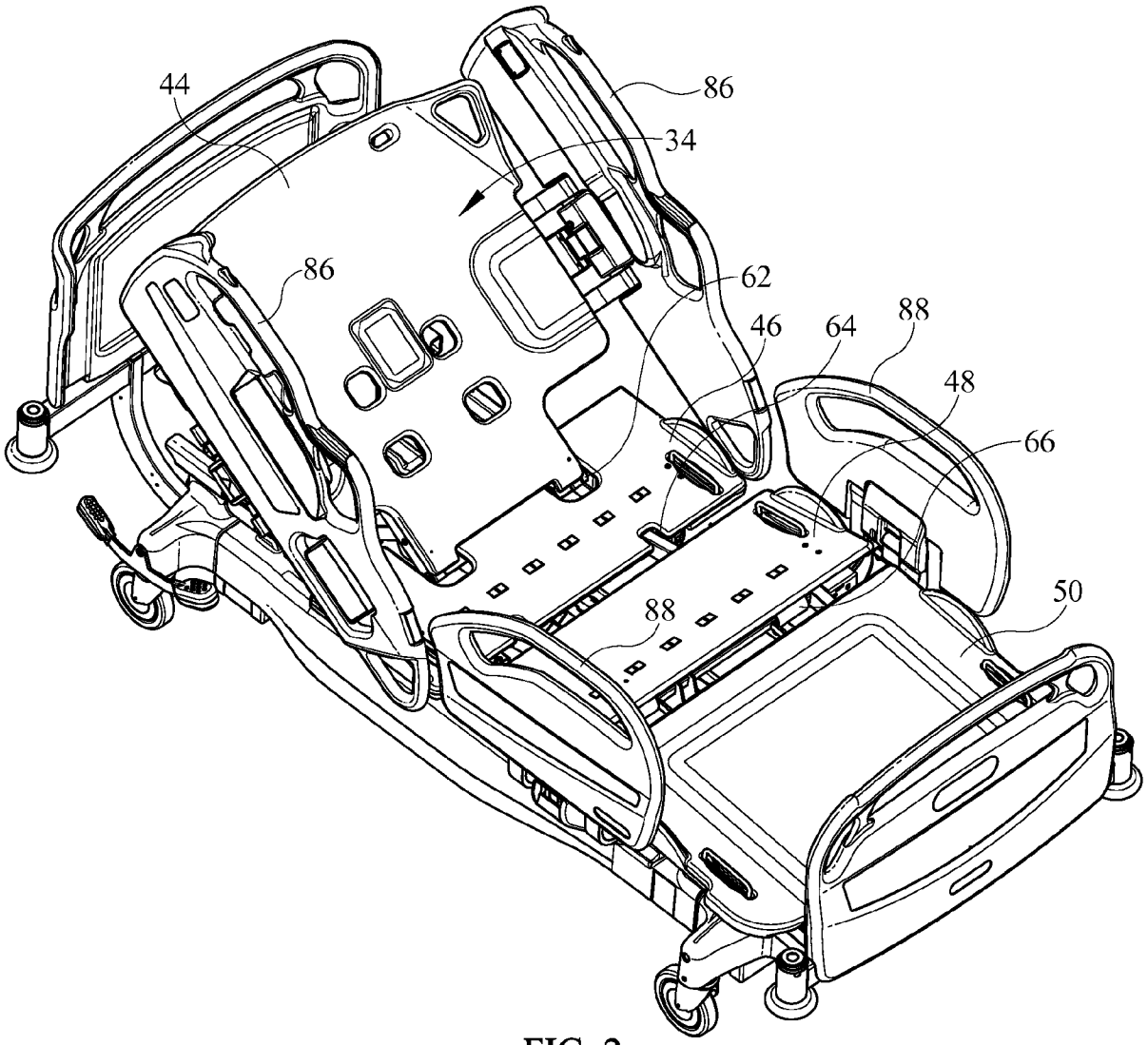
FIG. 2 is a view similar to FIG. 1 with the mattress removed to expose a four-section deck upon which the mattress rests.

FIGS. 1-2 show a bed 20 of the type typically used in hospitals or other health care settings. The bed extends laterally between a left side 22 and a right side 24 and longitudinally from a head end 26 to a foot end 28.

Figure 3:
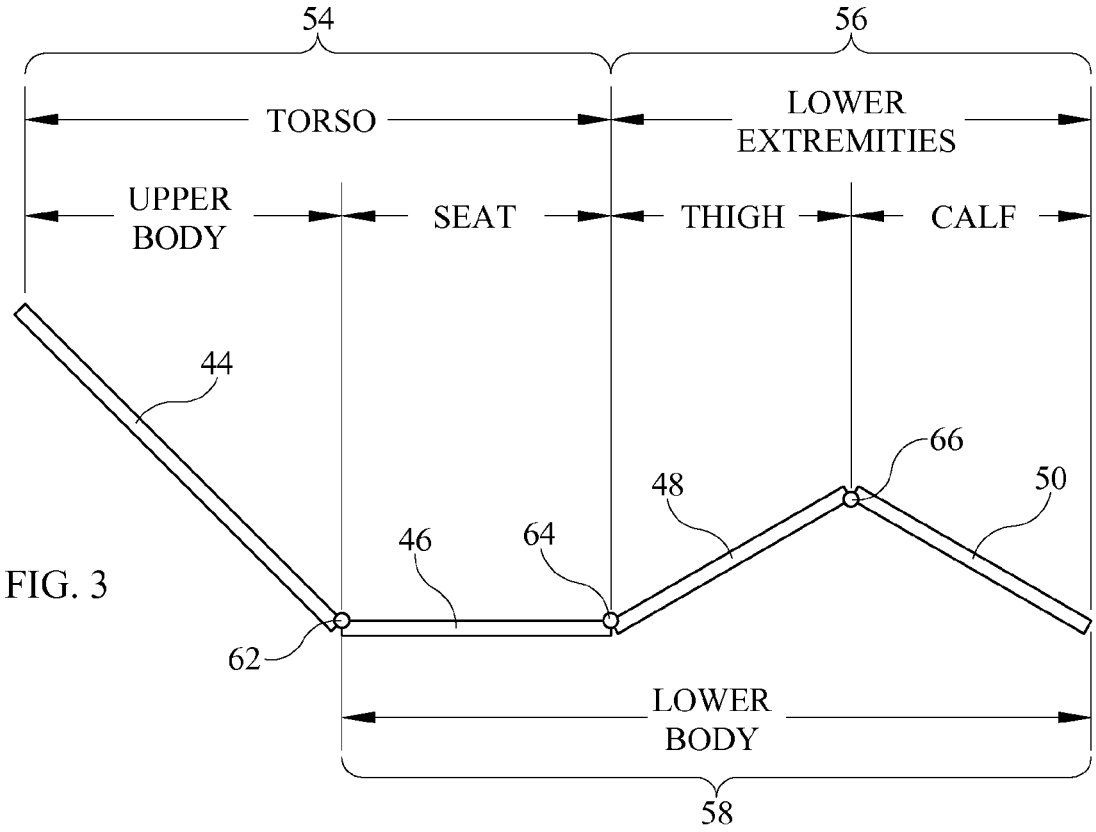
FIG. 3 is a schematic side elevation view of a four-section deck.
Figure 4:
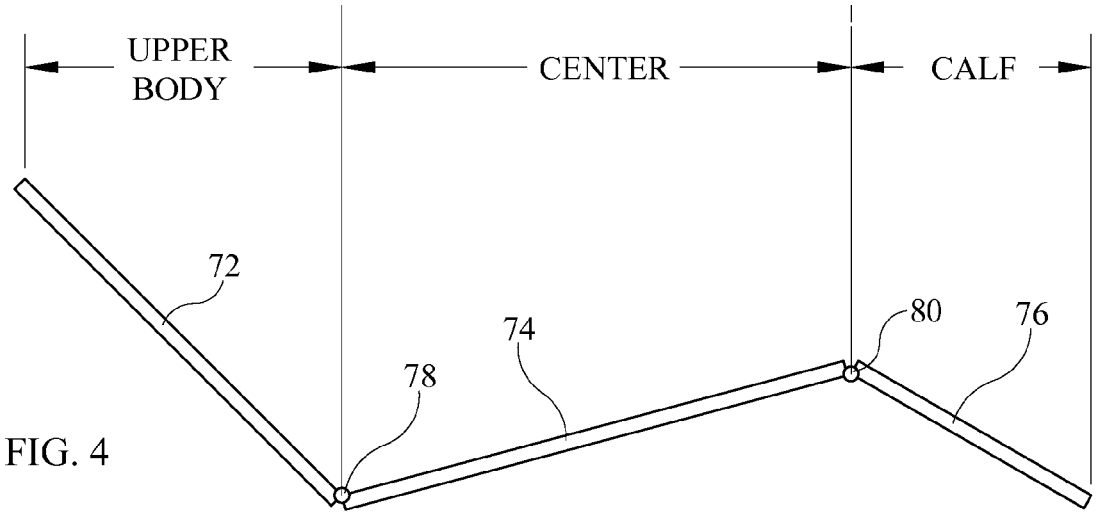
FIG. 4 is a schematic side elevation view of a three-section deck.
Figures 5, 5A:
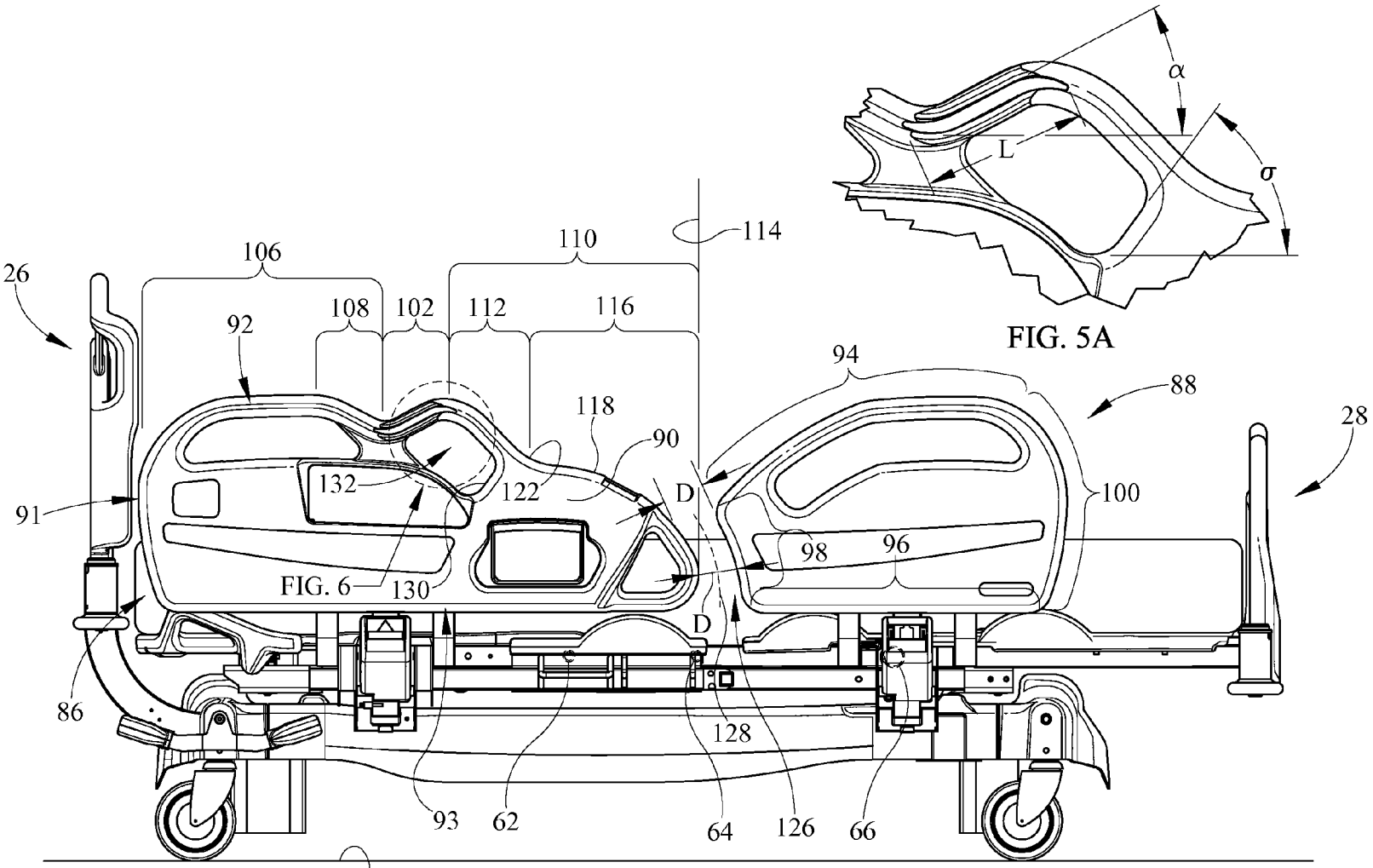
FIGS. 5-7 are a series of side elevation views of the bed of FIG. 1 with an upper body section of the deck at angular orientations of approximately 0, 35 and 65 degrees relative to a ground plane.
FIG. 5A is an enlarged view of a portion of FIG. 5.
Figures 7, 8:
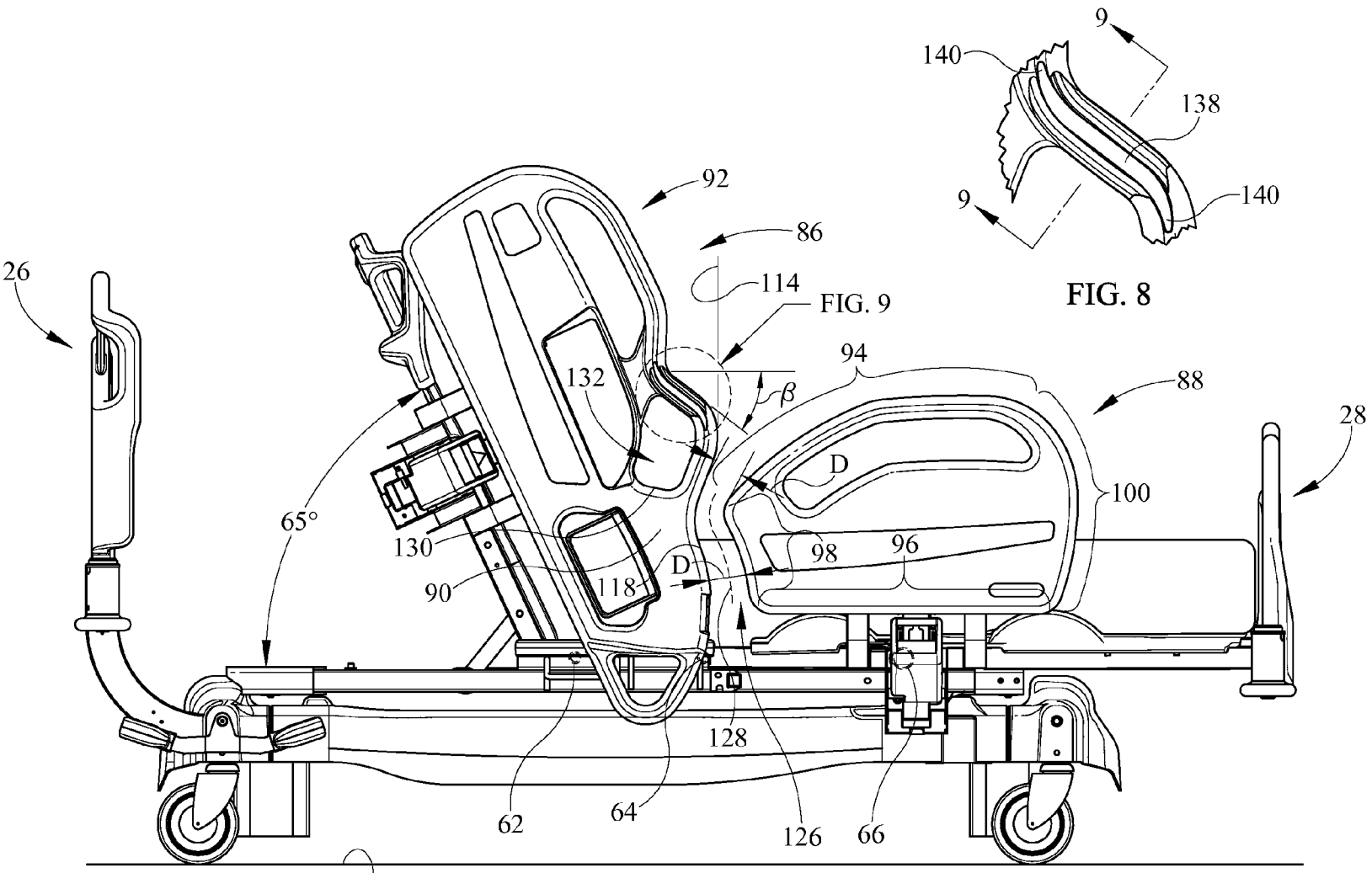
FIG. 8 is an enlarged view of a portion of the transition assist siderail of FIG. 1.

The bed includes a frame 32, an articulable deck 34 and a mattress 36 supported on the deck and having an occupant support side 38 spaced from the deck. The mattress may be sold separately or as part of the bed. Referring additionally to FIGS. 3 and 4, articulable decks usually include three or four longitudinally distributed deck sections. The four-section deck of FIGS. 2 and 3 includes an upper body section, 44, a seat section 46, a thigh section 48 and a calf section 50. The upper body and seat sections collectively define a torso section 54. The thigh and calf sections collectively define a lower extremities section 56. The seat, thigh and calf sections collectively define a lower body section 58. Joints 62, 64, 66 define upper, center and lower laterally extending pivot axes to allow relative pivotability of the deck sections. The three-section deck of FIG. 4 includes an upper body section 72, a center section 74 and a calf section 76. Joints 78, 80 define upper and lower laterally extending pivot axes to allow relative pivotability of the deck sections. In both cases, the upper body section 44 or 72 is pivotable relative to an adjacent deck section (the seat section 46 of FIG. 3 or the center section 74 of FIG. 4) about one of the laterally extending pivot axes (i.e. upper pivot axis 62 or 78). Referring momentarily to FIGS. 5 and 7, the upper body section is pivotable between a substantially flat angular orientation (FIG. 5) and a maximum angular orientation (FIG. 7). As used herein, a flat orientation is an orientation substantially parallel to a ground plane 84. The maximum angular orientation is about 65 degrees relative to the ground plane. It should be noted that not all the deck sections are necessarily pivotable. For example the seat section of FIGS. 2 and 3 is nonpivotable. Moreover, one or more of the pivot axes may translate during deck articulation.

Figure 6:
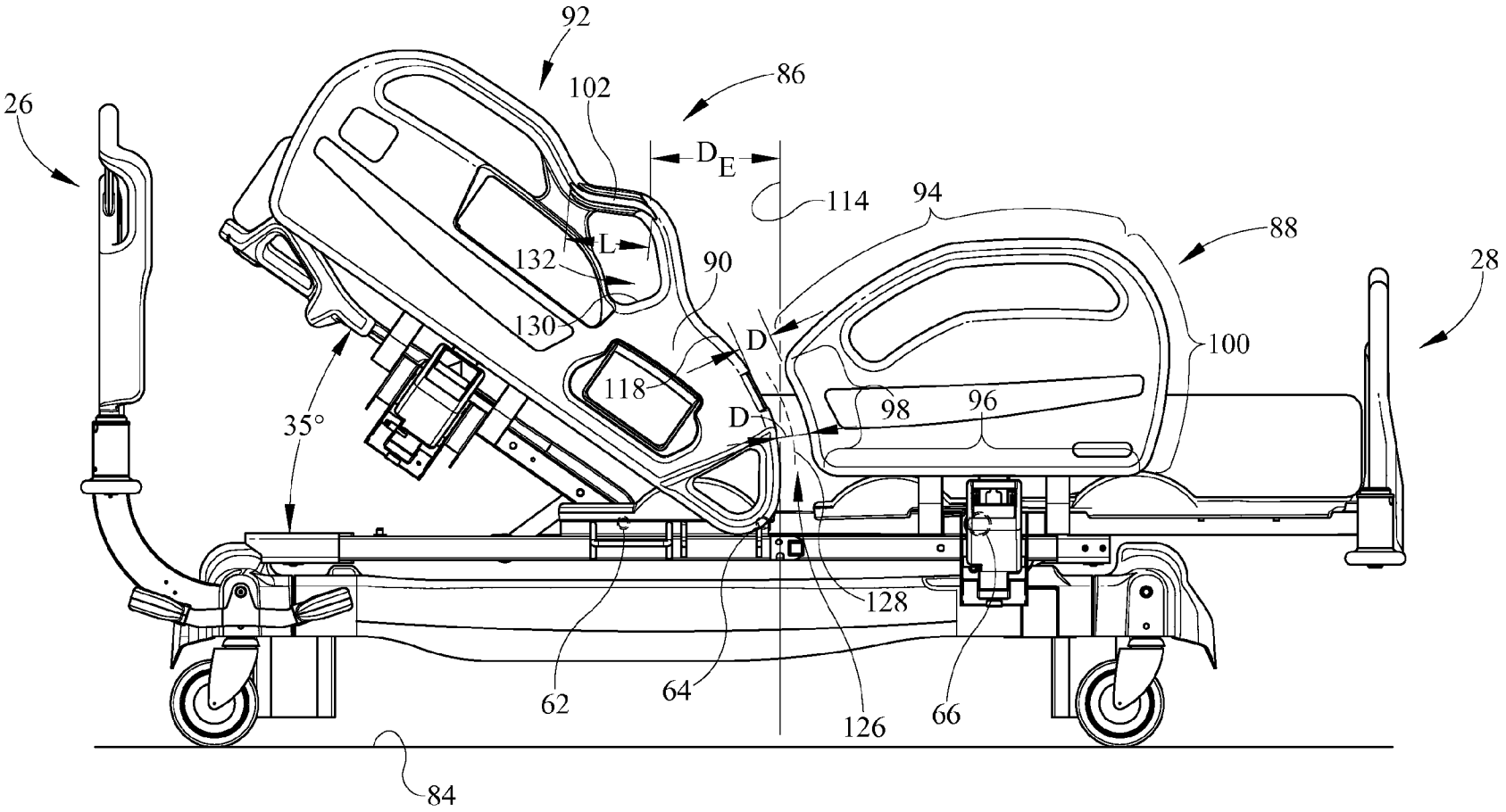

The bed also includes four siderails, head siderails 86 and foot siderails 88 bordering the mattress along the left and right lateral sides of the bed. Referring principally to FIGS. 5-7, each head siderail includes a main body 90, a top rail 92, a back border 91, and a bottom border 93. Each foot siderail includes a top perimeter segment 94, a bottom perimeter segment 96, a back perimeter segment 98 and a front perimeter segment 100. The head siderails are affixed to the deck upper body section. As a result the head siderails pivot along with the deck upper body section. The foot siderails are secured to the bed so that they do not pivot along with pivotable movement of a deck section. The four siderails can be raised (also referred to as deployed) or stored. When raised, a substantial portion of the siderail is above the top of the mattress, making it easy for the bed occupant to discern the location of the lateral edges of the mattress. In FIG. 1 both head end siderails and the left foot end siderail are shown in their raised position. When the siderails are stored the top of the siderail is typically below the top of the mattress, which allows the occupant to easily leave or enter the bed. In FIG. 1 the right foot end siderail is shown in its stored position. To facilitate occupant ingress and egress (collectively referred to herein as "transition") the foot siderail is stored and the head siderail is raised as seen in FIG. 1. The occupant can then brace herself on the head siderail during the transition from or onto the mattress.

The top rail 92 of each head siderail 86 includes a grip 102 that has an ascending orientation relative to the deck upper body section 44. As used herein in the context of a feature or portion of the siderail, "ascending" means that with the upper body section at or near a substantially flat orientation, the elevation of the feature (e.g. the grip) relative to the ground plane 84 increases with increasing distance away from the head end 26 of the bed. Equivalently, "ascending" means that the distance between the feature (e.g. the grip) and the deck upper body section increases with increasing distance away from the siderail back border 91 irrespective of the angular orientation of the deck upper body section relative to the ground plane. Specifically, the grip is at an angular orientation $\alpha$ of between about 26 degrees and about 45 degrees relative to the ground plane (when the deck upper body section 44 is substantially flat) or relative to the deck upper body section itself independent of the orientation of the upper body section. With the upper body section at an angular orientation of about 35 degrees (FIG. 6), which is the orientation judged to be most satisfactory for occupant ingress or egress, the grip orientation is approximately parallel to the ground plane. With the upper body section at its maximum orientation of about 65 degrees (FIG. 7) the grip is at a descending angle $\beta$ of no more than about 45 degrees relative to the ground plane.

The grip 102 is longitudinally bordered by a siderail back portion 106 located behind the grip and extending longitudinally toward the back border 91. The front end of the back portion 106 is a back transition region 108 that blends with the grip and has a descending orientation. As used herein in the context of a feature or portion of the siderail, "descending" means that with the upper body section at or near a substantially flat orientation, the elevation of the feature (e.g. the back transition region 108) relative to the ground plane 84 decreases with increasing distance away from the head end 26 of the bed. Equivalently, "descending" means that the distance between the feature (e.g. the back transition region) and the deck upper body section decreases with increasing distance away from the back border 91 of the siderail irrespective of the angular orientation of the deck upper body section relative to the ground plane. The grip is also bordered by a siderail front portion 110 located in front of the grip. At least part of the front portion, e.g. the part neighboring the grip has a non-ascending orientation. The grip has an effective length L (FIG. 5A) between the siderail back portion 106 and the front portion 110.

As shown in FIGS. 5-7 the forwardmost extremity of the siderail defines an egress (or ingress) plane 114 (during occupant ingress or egress the foot siderail 88 on the side of the bed used for ingress or egress would be in its stored or lowered position). With the upper body section at an orientation compatible with occupant ingress or egress, for example an orientation of about 35 degrees (FIG. 6), the grip is at a height and at a longitudinal location that renders it accessible to and useable by an occupant transitioning into or out of the bed. Such positioning can be determined by readily available anthropometric data. In the illustrated siderail the extremity of the grip closest to the egress plane is spaced from the egress plane by a distance $D_E$ no greater than about two times the effective length L of the grip. The distance $D_E$ is taken in a direction parallel to the ground plane.

Referring principally to FIG. 8 the laterally inner and outer flanks of the grip have a shallow, elongated, serpentine shaped recess 138 with tapered termini 140. The recess offers the bed occupant a tactile clue as to the location of the grip portion of the siderail.

Figure 9:
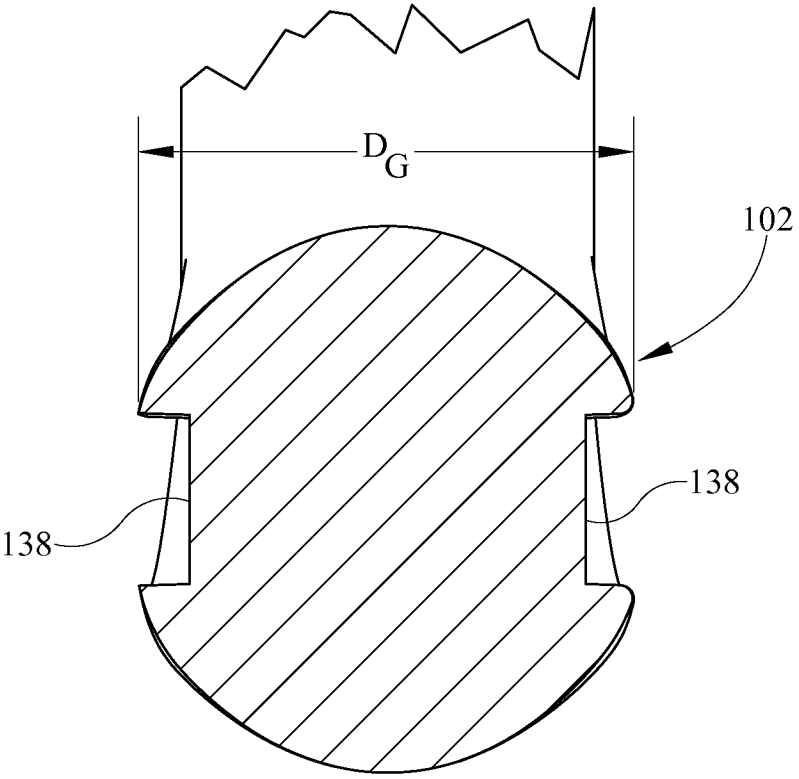
FIG. 9 is a cross sectional view of a grip portion of the transition assist siderail.

FIG. 9 shows a cross sectional view of the grip taken in the directions 9-9 of FIG. 8. The grip has an approximately circular cross section whose diameter $D_G$ is selected to be compatible with the size of a human hand so that the occupant can use the grip effectively to assist her transition into and out of the bed. A diameter $D_G$ in the range of about 1.9 to about 4.1 centimeters (cm) is considered to be reasonably well sized. Cross sectional geometries other than the illustrated geometry can be used if desired.

The front transition portion of the illustrated head siderail 86 comprises a front transition region 112 and a nose 116. The nose 116 is that portion of the head siderail that cooperates with the back perimeter segment 98 of the longitudinally neighboring foot siderail 88 to define an inter-rail space 126 when both siderails are raised. As is evident from FIGS. 5-7 different portions of the nose engage in such cooperation with the back segment 98 depending on the orientation of the upper body deck section. The nose blends into and extends ahead of the front transition region 112. The juncture or inflection 122 between the nose and the front transition region is a concave-up juncture. Not all siderails will necessarily have a front portion with a distinctly identifiable nose and front transition region. Moreover, beds having only one siderail, such as siderail 86, on each side of the bed will not have a nose as defined herein.

The inter-rail space has a meanline 128. The inter-rail space has a dimension D, measured perpendicular to the meanline, that may vary as a function of distance along the meanline. Transnationally recognized regulations published by the International Electrotechnical Commission (IEC) and in existence on the filing date of this application specify that the dimension D be no less than 25 millimeters (mm) and no more than 60 mm.

The siderail also includes a boost surface 130. The boost surface faces toward the grip 102 and is located in front of the grip. As seen best in FIG. 5A the boost surface has an ascending angular orientation $\sigma$ steeper than the orientation $\alpha$ of the grip. The boost surface orientation is between about 43 degrees and about 63 degrees relative to the ground plane (when the deck upper body section is substantially flat) or relative to the deck upper body section itself independent of the orientation of the deck upper body section. The bed occupant can push against the boost surface with her hand, when necessary, to boost herself toward the head end of the bed.

Figure 10:
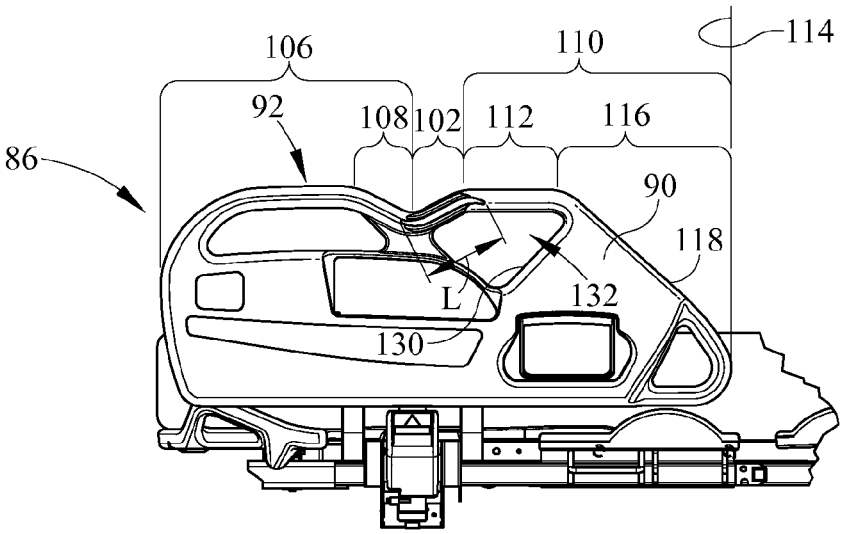
FIGS. 10-12 are a series of side elevation views similar to those of FIGS. 5-7 showing an alternate transition assist siderail.
Figure 11:
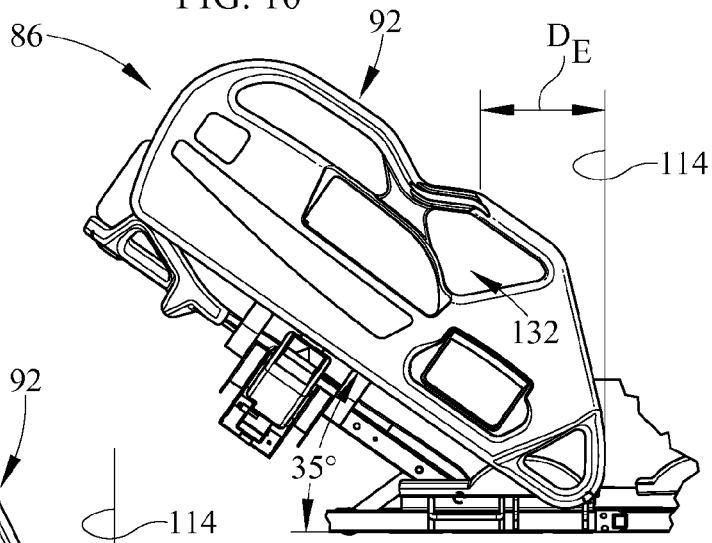
Figure 12:
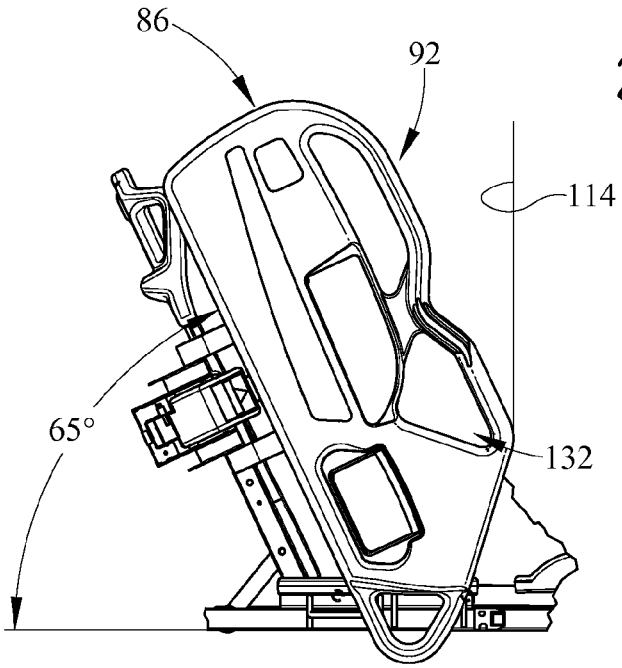

FIGS. 10-12 show a variant of the siderail in which part of the non-ascending front portion 110 is substantially parallel to the ground plane 84.

Figure 13:
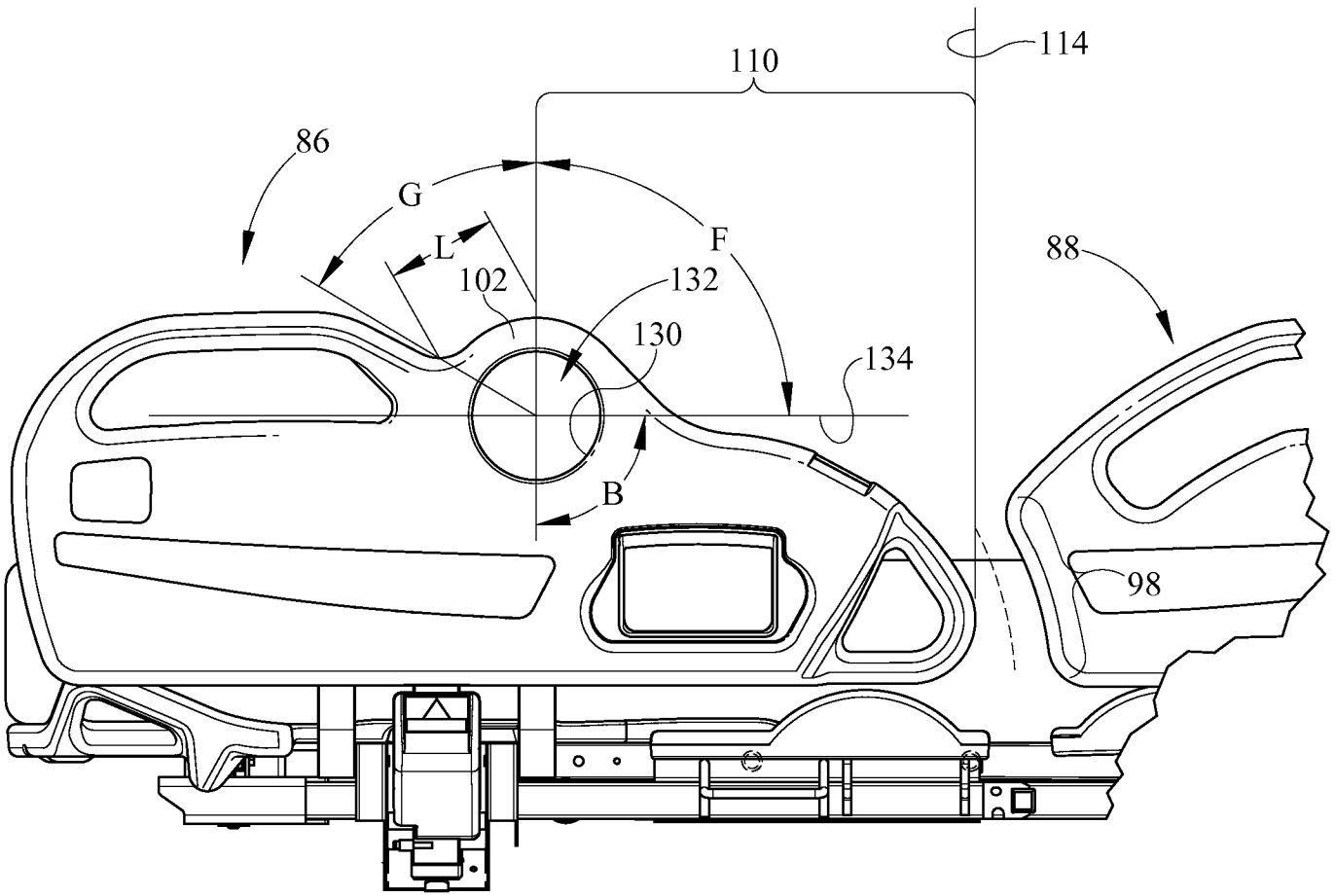
FIGS. 13-15 are a series of side elevation views similar to those of FIGS. 5-7 showing another alternate transition assist siderail.
Figure 14:
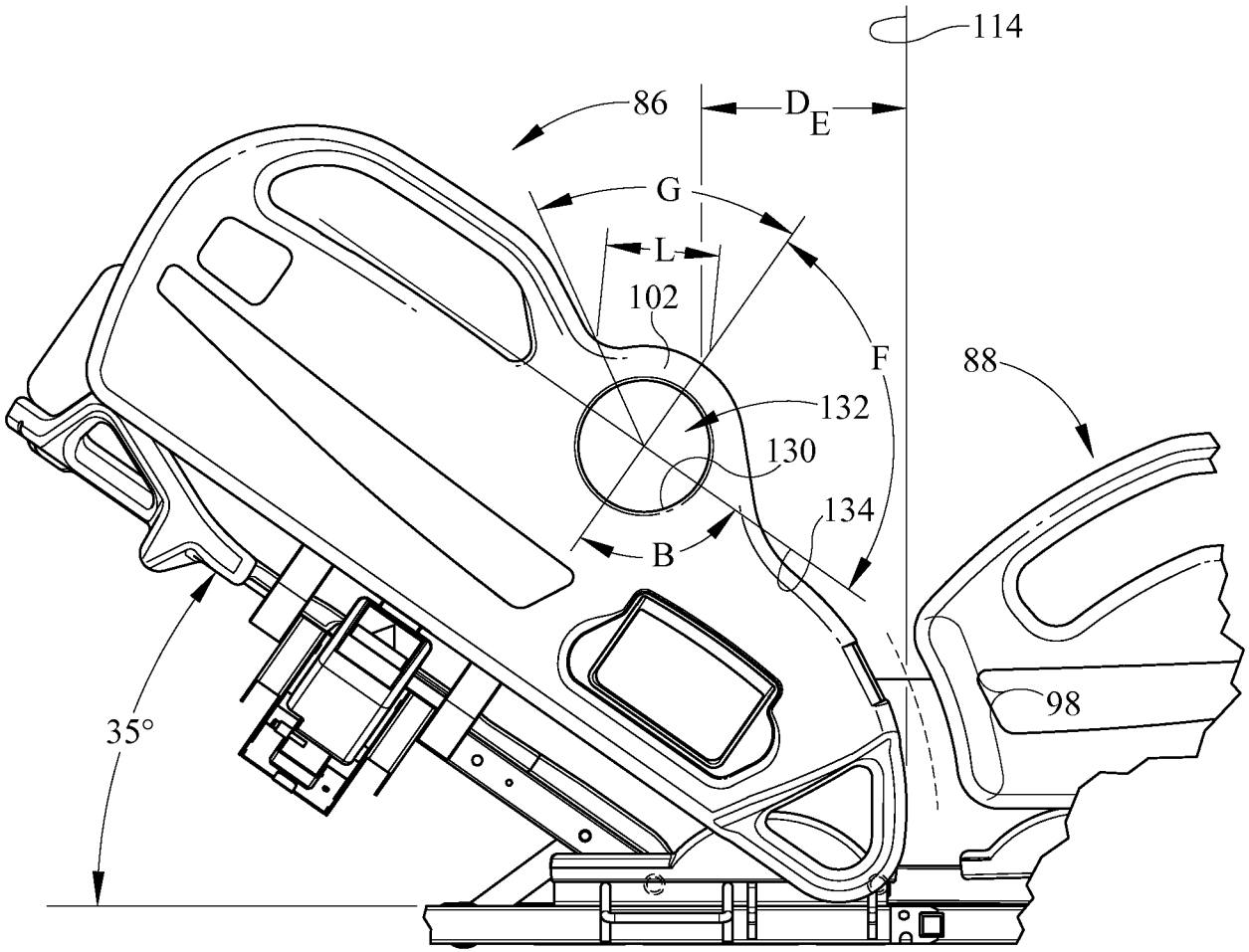
Figure 15:
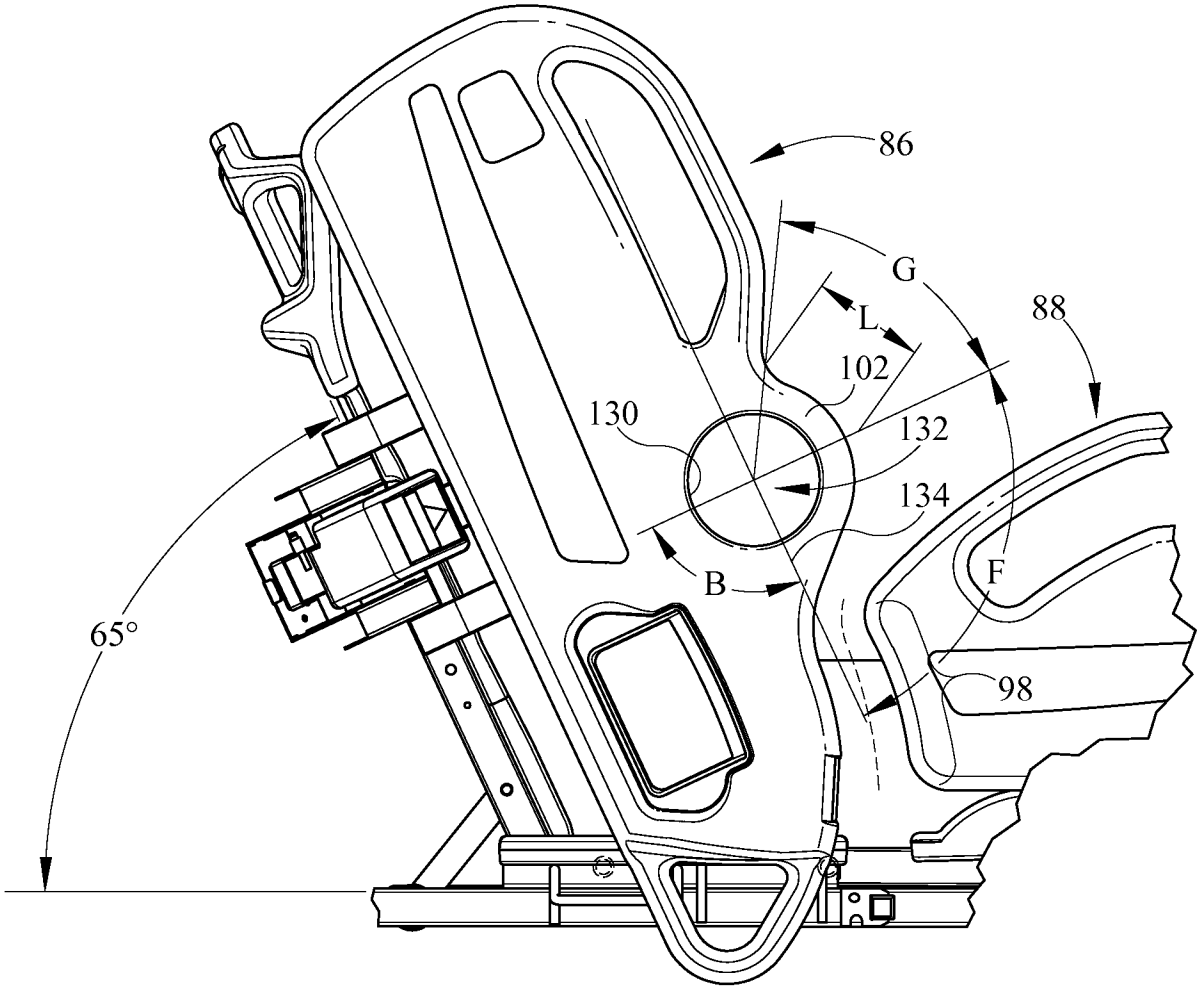

The grip 102, the front portion 110, the boost surface 130 and the main body 90 of the siderails shown in FIGS. 5-7 and 10-12 define an opening having an approximately quadrilateral shape. The grip has a substantially linear profile as seen in side elevation. Other opening shapes such as the approximately circular shape seen in FIGS. 13-15 can also be used, which results in a grip having a noticeably nonlinear profile. In the siderail of FIGS. 13-15 the grip 102 corresponds to the sector G extending from about 90 degrees to about 150 degrees relative to a coordinate axis 134 parallel to the deck upper body section. The front transition region corresponds to the sector F extending from about 0 degrees to about 90 degrees. The boost surface 130 corresponds to the sector B extending from about 0 degrees to about minus 90 degrees.

When a person wishes to leave or enter the bed, the foot siderail on one lateral side of the bed is placed in its stored position and the head siderail is placed in its raised position as seen in FIG. 1. As a result, the grip 102 is at a higher elevation than the occupant support side 38 of the mattress. Both siderails on the laterally opposite side of the bed are preferably in their raised positions. The deck upper body section is pivoted to about 35 degrees, although occupant egress and ingress can also be accomplished at other orientations of the upper body section. The other sections of the deck are typically oriented so that the support side of the mattress portion that overlies those deck sections defines a surface that is approximately flat and approximately parallel to the ground plane. The person may then use the grip to assist her transition into or out of the bed. With the upper body section at about a 35 degree orientation the grip is approximately parallel to the ground plane, which is a desirable orientation for allowing the patient to brace herself during the transition. However if the upper body section is at other orientations the grip will still be at an orientation that offers some degree of support and assistance for the transitioning individual. As already noted, the occupant can also use the boost surface 130 to boost herself toward the head end of the bed when necessary.

Figure 16:
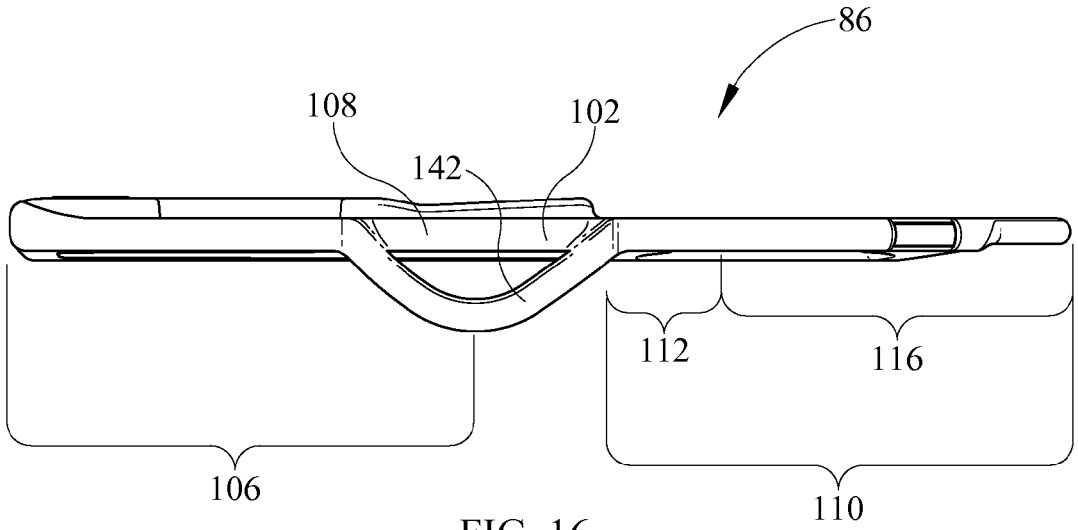
FIGS. 16 and 17 are a plan (top) view and a side elevation view showing another variant of the transition assist siderail.
Figure 17:
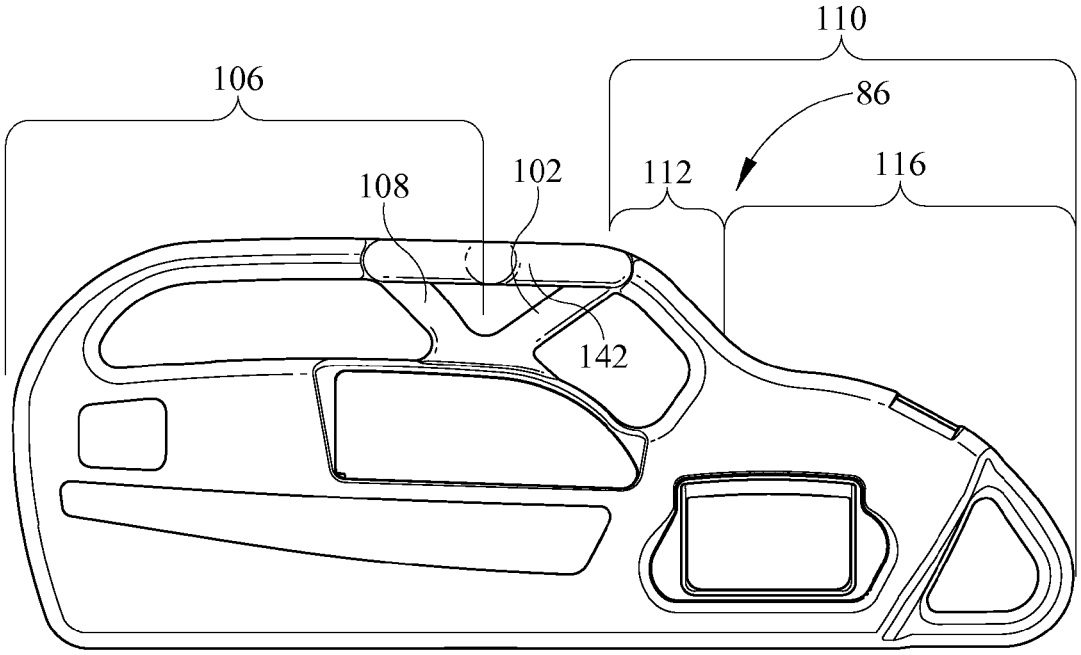

FIGS. 16-17 show another variant of the transition assist siderail including a connecting rail 142 that extends longitudinally between non-neighboring ends of the back transition region and the grip. The connecting rail also projects laterally away from the mattress to afford the bed occupant access to the grip 102.

Although this disclosure refers to specific embodiments, it will be understood by those skilled in the art that various changes in form and detail may be made without departing from the subject matter set forth in the accompanying claims.

We claim:

1. An occupant support comprising:

an articulable deck having an upper body section and a section longitudinally adjacent the upper body section, the upper body section being pivotable relative to the adjacent section about a laterally extending upper pivot axis between a substantially flat angular orientation and a maximum angular orientation; and a siderail affixed to the upper body section, the siderail including a grip having an ascending orientation relative to the upper body section, the grip being longitudinally bounded by a siderail back portion located behind the grip and a siderail front portion located in front of the grip, at least part of the front portion having a non-ascending orientation relative to the upper body section.

2. The occupant support of claim 1 including:

a mattress supported on the deck, the mattress having an occupant support side spaced from the deck;

the grip being at a higher elevation than the occupant support side when the siderail is deployed.

3. The occupant support of claim 2 wherein the grip has an effective length and with the upper body section at an orientation of about 35 degrees, the extremity of the grip closest to an egress plane is spaced from the egress plane by a distance $D_E$ no greater than about two times the effective length L of the grip.

4. The occupant support of claim 1 wherein the siderail back portion has a back transition region that blends with the grip and has a descending orientation.

5. The occupant support of claim 1 wherein the front portion comprises a front transition region and a nose.

6. The occupant support of claim 1 wherein the part of the front portion neighboring the grip has a non-ascending orientation.

7. The occupant support of claim 1 wherein with the upper body section in a substantially flat orientation, the grip is at an orientation of between about 26 degrees and 45 degrees relative to a ground plane.

8. The occupant support of claim 1 wherein with the upper body section at an orientation compatible with occupant transition, the grip is at a height and at a longitudinal location that renders it accessible to and useable by an occupant transitioning into or out of the bed.

9. The occupant support of claim 8 wherein the compatible orientation is about 35 degrees.

10. The occupant support of claim 8 wherein the height and longitudinal location of the grip are a function of anthropometric data.

11. The occupant support of claim 1 wherein with the upper body section at an orientation of about 35 degrees the grip orientation is approximately parallel to a ground plane.

12. The occupant support of claim 1 wherein with the upper body section at an orientation of about 65 degrees the grip is at a descending angle relative to a ground plane, the descending angle being no greater than about 45 degrees.

13. The occupant support of claim 1 wherein the grip has an approximately circular cross section having a diameter in the range of about 1.9 to about 4.1 centimeters.

14. The occupant support of claim 1 wherein the grip is at an uppermost border of the siderail.

15. The occupant support of claim 1 wherein the siderail includes a boost surface having an ascending orientation steeper than the orientation of the grip.

16. The occupant support of claim 15 wherein the boost surface faces toward the grip and is located in front of the grip.

17. The occupant support of claim 16 wherein the grip, the front portion, the boost surface and a main body of the siderail define an approximately quadrilateral opening.

18. The occupant support of claim 1 wherein flanks of the grip include a recess.

19. The occupant support of claim 18 wherein the recess has an elongated serpentine shape with tapered termini.

20. The occupant support of claim 1 wherein the deck has exactly three serially distributed sections, the adjacent section being a center section longitudinally between the upper body section and a calf section.

21. The occupant support of claim 1 wherein the deck has exactly four serially distributed sections, the adjacent section being a seat section, the other two sections being a thigh section and a calf section.

* * * * *